US006499255B1

(12) United States Patent
Givoni

(10) Patent No.: US 6,499,255 B1
(45) Date of Patent: Dec. 31, 2002

(54) PANELS OF CONTROLLABLE RADIATION TRANSMISSIVITY

(75) Inventor: Shaul Givoni, Upper Galilee (IL)

(73) Assignee: Dan-Pal, Upper Galilee (IL)

( * ) Notice: Subject to any disclaimer, the term of this patent is extended or adjusted under 35 U.S.C. 154(b) by 0 days.

(21) Appl. No.: 09/719,676

(22) PCT Filed: Jun. 15, 1999

(86) PCT No.: PCT/IL99/00326

§ 371 (c)(1),
(2), (4) Date: Feb. 28, 2001

(87) PCT Pub. No.: WO99/66149

PCT Pub. Date: Dec. 23, 1999

(30) Foreign Application Priority Data

Jun. 15, 1998 (IL) ..... 124949

(51) Int. Cl.[7] ..... E06B 7/096

(52) U.S. Cl. ..... 49/82.1; 49/74.1; 49/92.1; 160/236

(58) Field of Search ..... 49/74.1, 92.1, 49/82.1; 160/236

(56) References Cited

U.S. PATENT DOCUMENTS

| | | | | |
|---|---|---|---|---|
| 1,520,232 A | * | 12/1924 | French | 49/82.1 |
| 3,012,294 A | * | 12/1961 | Waldor | 160/236 |
| 4,111,183 A | * | 9/1978 | Haberthier | 126/270 |
| 4,435,919 A | * | 3/1984 | Poisson | 160/236 |
| 4,773,733 A | * | 9/1988 | Murphy et al. | 160/236 |
| 5,052,150 A | * | 10/1991 | Chen | 49/82.1 |
| 5,600,920 A | | 2/1997 | Roy | |
| 6,015,002 A | * | 1/2000 | Biro et al. | 160/236 |
| 6,314,680 B1 | * | 11/2001 | Buckwalter et al. | 49/82.1 |

FOREIGN PATENT DOCUMENTS

| | | |
|---|---|---|
| DE | 34 34 413 A1 | 5/1986 |
| DE | 196 32 684 A1 | 2/1998 |

* cited by examiner

*Primary Examiner*—Jerry Redman
(74) *Attorney, Agent, or Firm*—Smith, Gambrell & Russell, LLP

(57) ABSTRACT

The invention provides a panel (2) of controllable radiation transmissivity, including a plurality of tubular cells (4), in at least some of which cells is rotatably mounted at least one radiation-blocking member (6), at least one portion of at least one surface of which is substantially opaque, and means (8) for rotating the radiation-blocking member (6) inside the tubular cells (4), wherein the radiation-blocking member (6), when rotated, is adapted, in at least one angular position, to substantially block the passage of radiation through the panel (2), and in a plurality of other, selectable, angular positions, to provide a plurality of differing radiation transmissivities.

31 Claims, 11 Drawing Sheets

2
4
4'
6
8
10
10
12
12'
14
15
20
26
28
30
32
P

PANELS OF CONTROLLABLE RADIATION TRANSMISSIVITY

TECHNICAL FIELD

The present invention relates to a panel of controllable radiation transmissivity for the construction of walls, roofs, awnings, skylights, windows, and the like.

BACKGROUND ART

While panels for the above or similar purposes are known, they are either transparent, translucent or opaque, but their transmissivity is predetermined and cannot be altered or modified. Yet such alterability would be most useful, especially in hot climates where reduced insolation during the hot hours would reduce air-conditioning costs, or in cold climates where increased insolation would reduce heating expenses.

U.S. Pat. No. 5,600,920 describes a motorized louver blind structure including slat members operable inside a chamber formed by a double-glazed window unit, to effect pivoting of the slats.

DISCLOSURE OF THE INVENTION

It is thus one of the objects of the present invention to provide a panel for the construction of roofs, walls, awnings, skylights, windows and the like, the radiation transmissivity of which can be set at will to any state, from almost full transparency or translucency to almost total opacity.

According to the invention, the above object is achieved by providing a panel of controllable radiation transmissivity, comprising a plurality of rotatably mounted radiation-blocking members, each of said members having at least one portion which is substantially opaque, and means for rotating said radiation-blocking members, said radiation-blocking members, when rotated, being adapted in at least one angular position to substantially block the passage of radiation through said panel, and in a plurality of other, selectable, angular positions, to provide a plurality of differing radiation transmissivities, characterized by a plurality of substantially transparent tubular cells, at least one of said radiation-blocking members being mounted in at least some of said tubular cells, and means for rotating said radiation-blocking members inside said tubular cells.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a perspective view of a fully assembled panel according to the invention;

FIG. 2 illustrates a first arrangement for mounting the panel on the purlins of a roof structure;

FIG. 3 shows a different type of clamping rail;

FIG. 4 shows a second arrangement for mounting the panel on the purlins of a roof structure;

FIG. 5 shows a first profile of the cells of the panel member according to the invention;

FIGS. 6 to 8 represent other possible profiles of the cells;

FIG. 9 is a perspective view of a preferred embodiment of the radiation-blocking member according to the invention;

FIG. 10 is an end view of the radiation-blocking member of FIG. 9, located inside a cell;

FIG. 11 is a perspective view of another embodiment of the radiation-blocking member;

FIG. 12 is a perspective view of yet another embodiment of the radiation-blocking member;

FIG. 13 is a variant of the radiation-blocking member of FIG. 12;

Figures 9, 10:
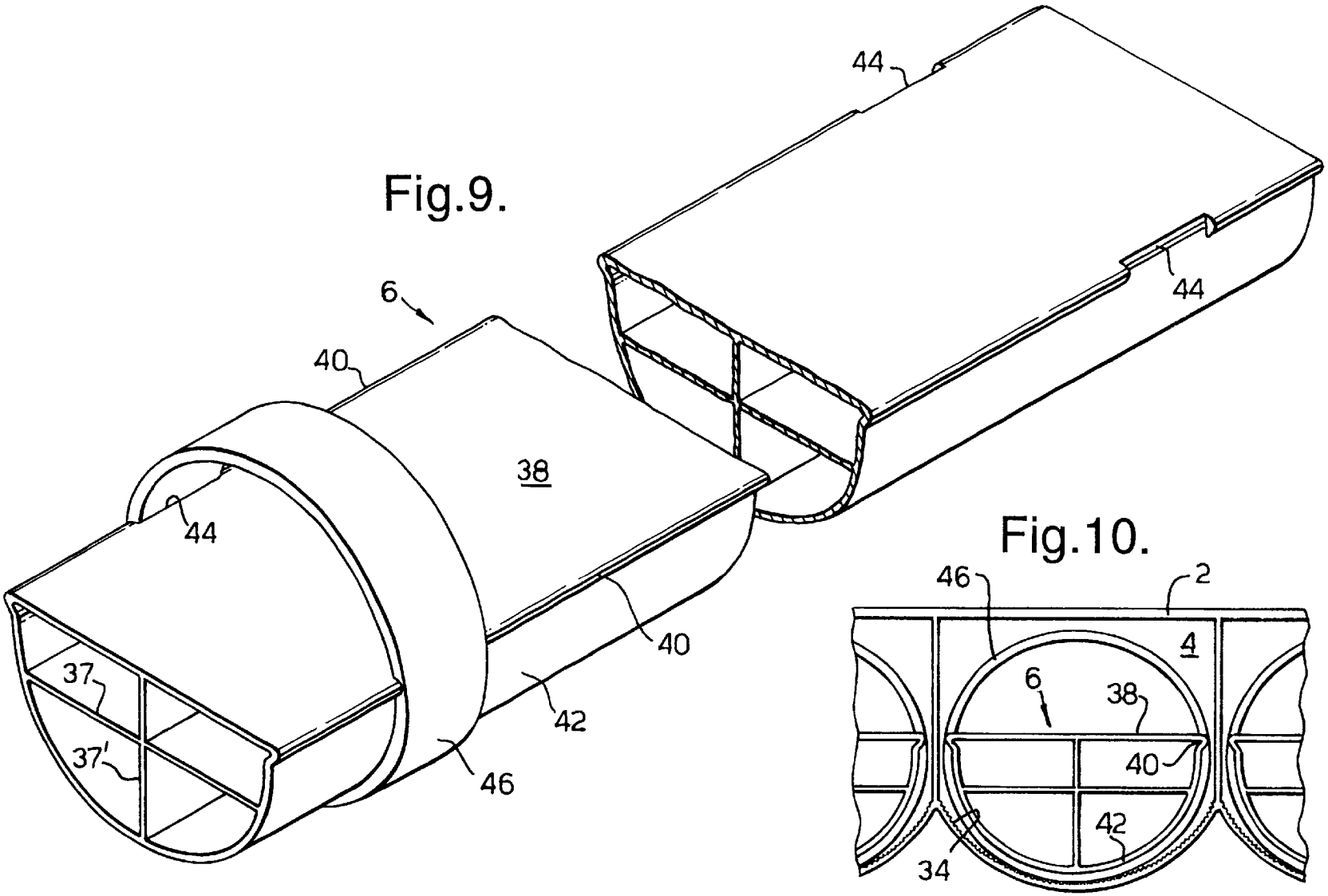
Figure 14:
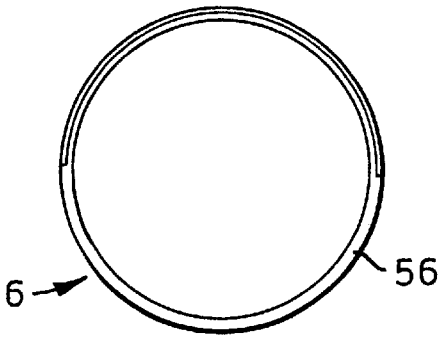
Figure 15:
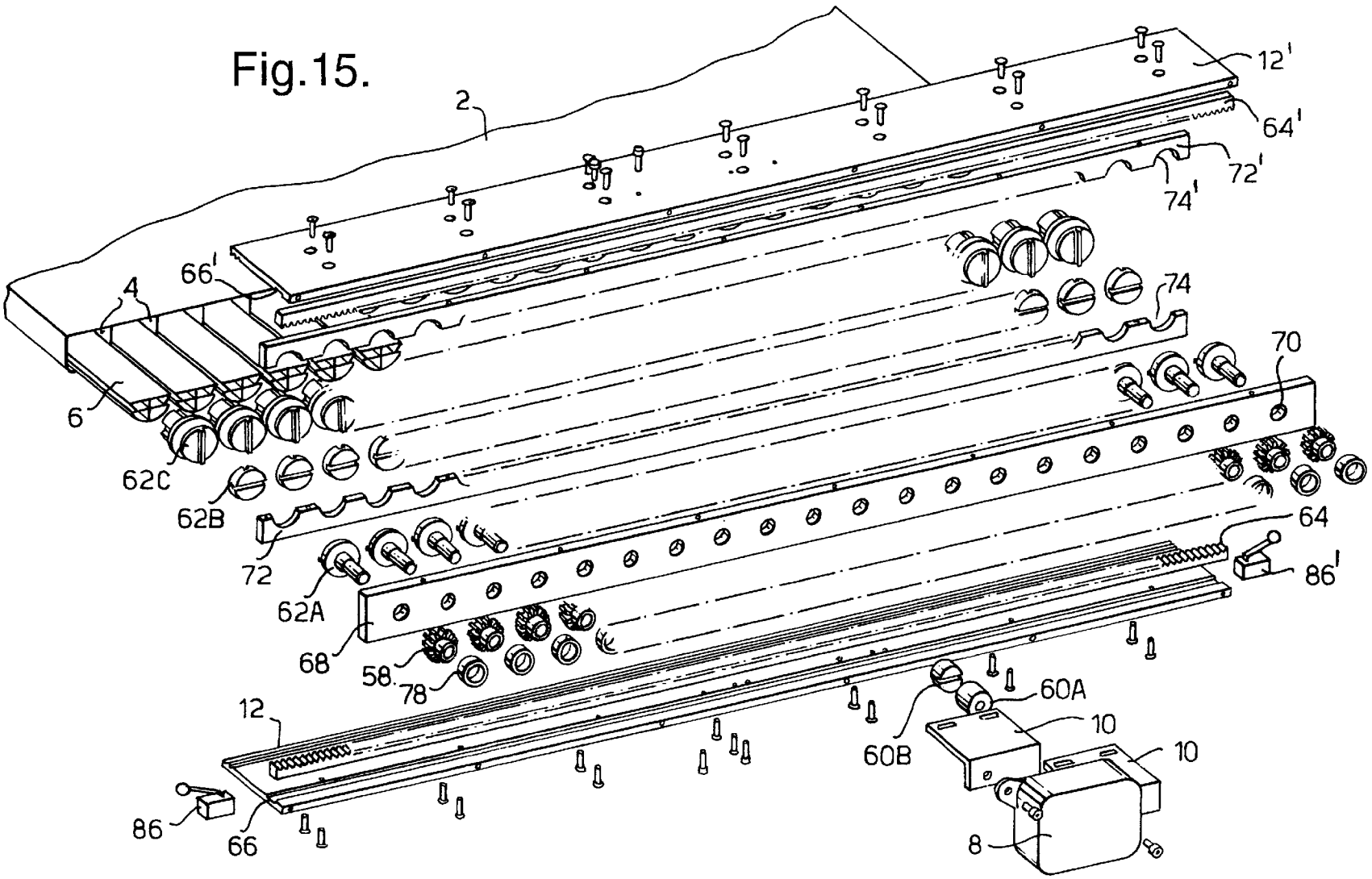
Figure 16:
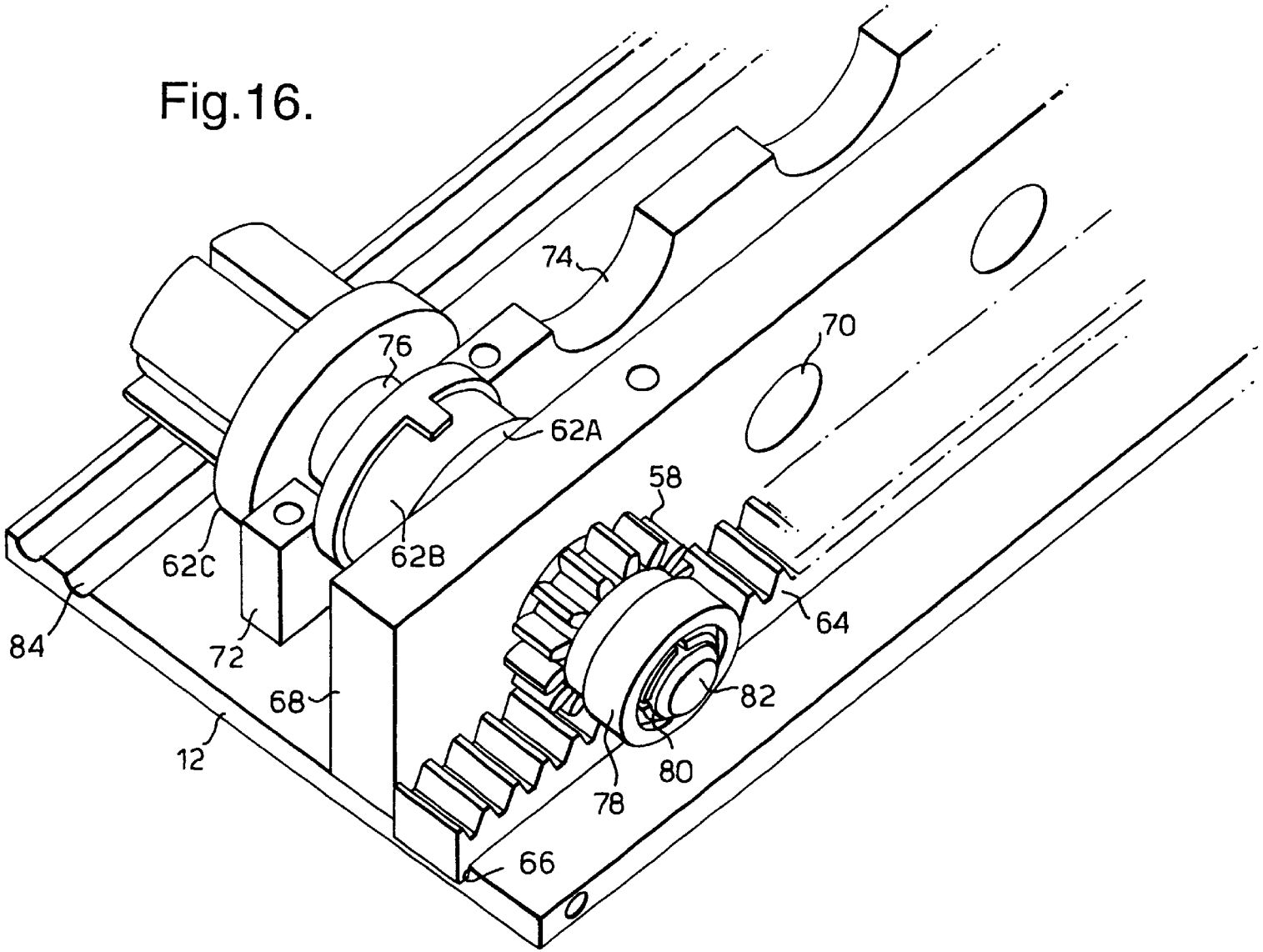
Figure 17:
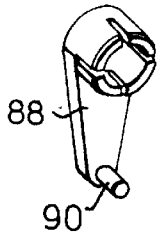
Figure 18:
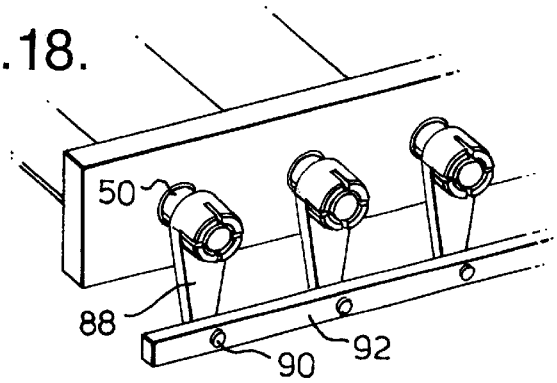
Figure 19A:
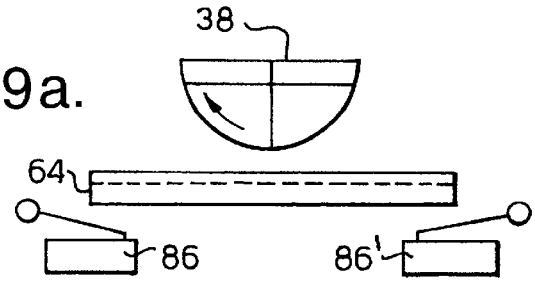
Figure 19B:
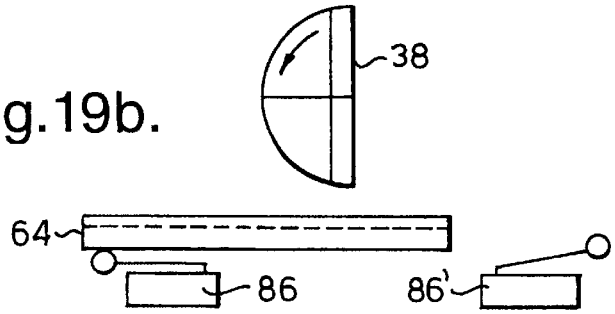
Figure 19C:
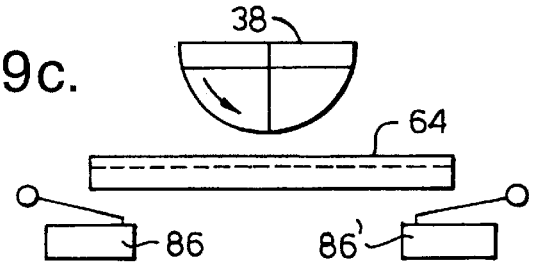
Figure 19D:
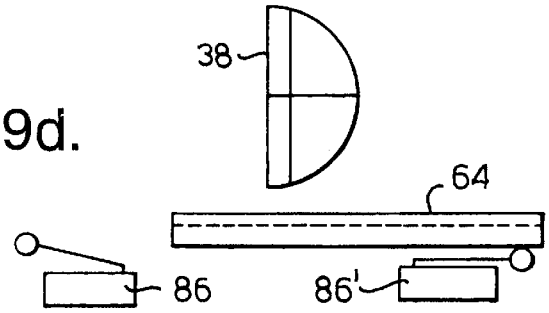
Figure 20:
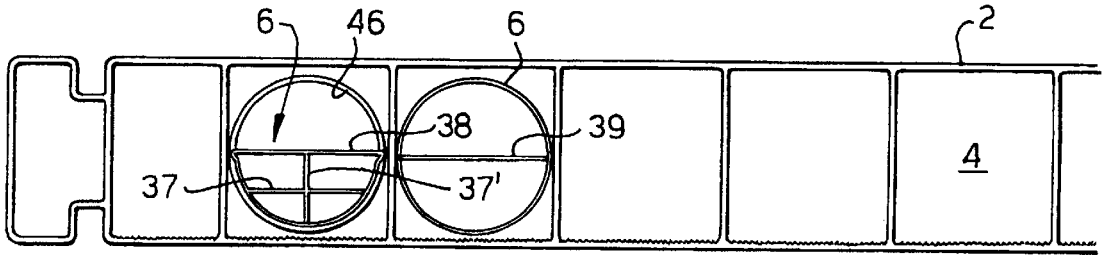
Figure 22:
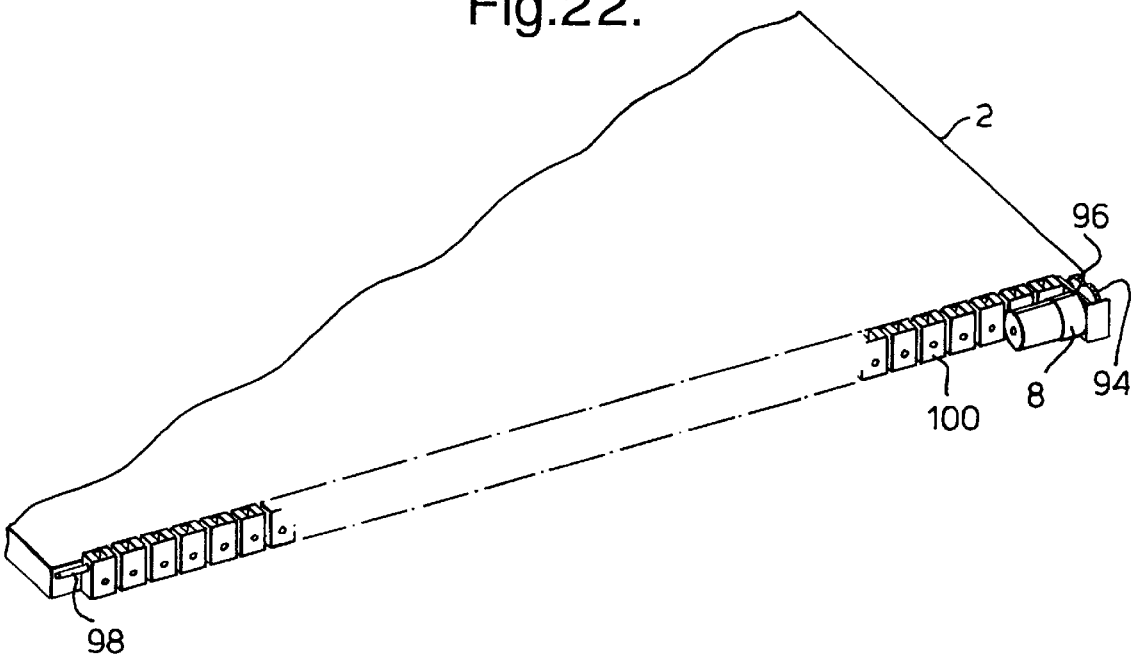
Figure 21:
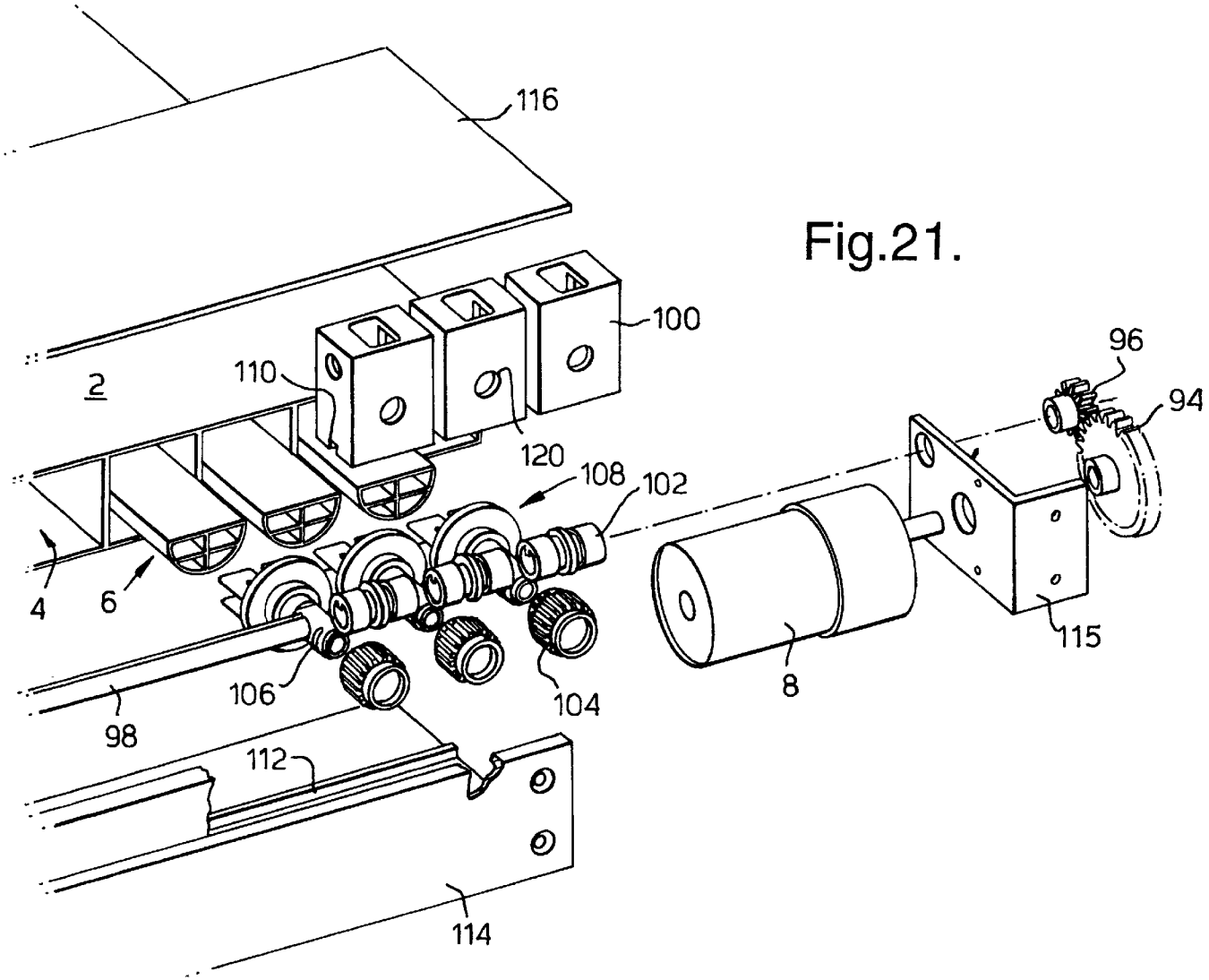
Figure 24:
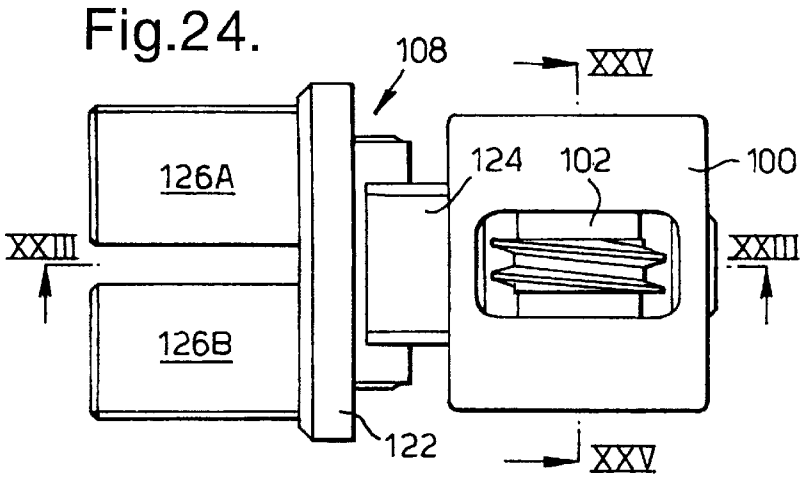
Figure 26:
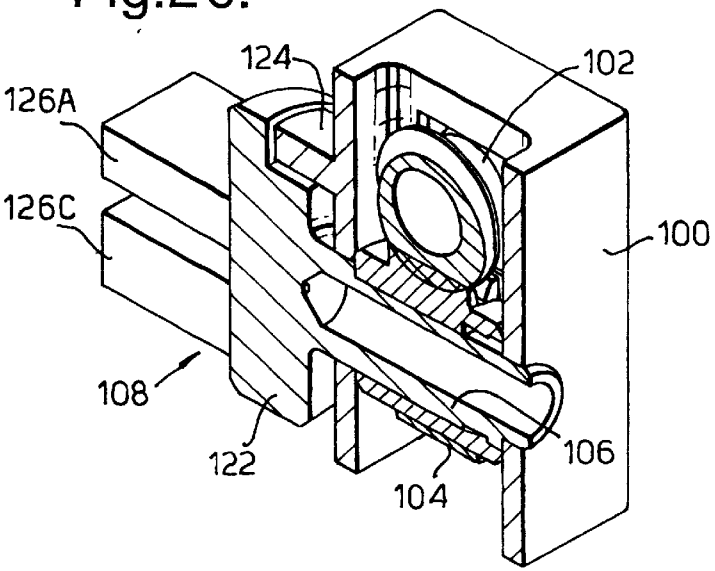
Figure 23:
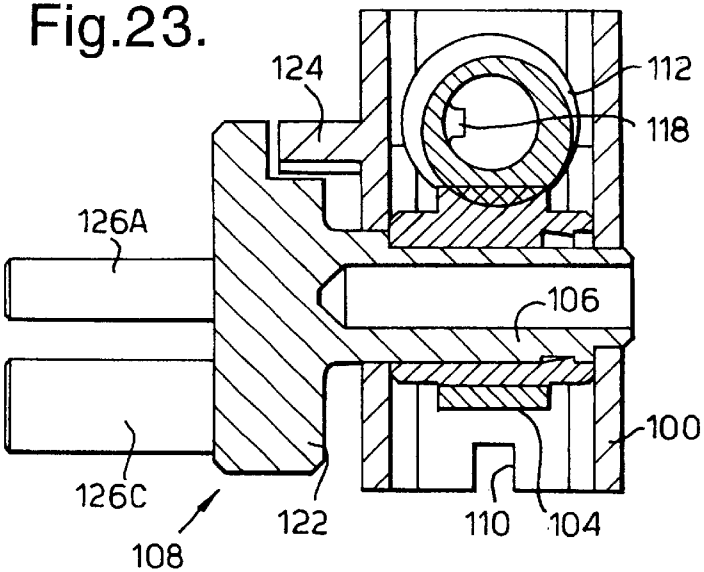
Figure 25:
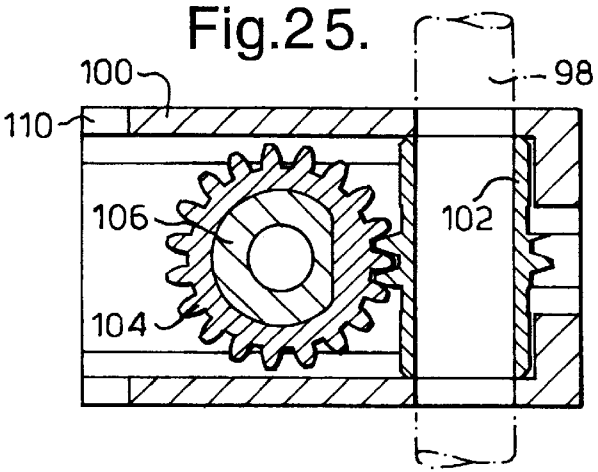
Figure 27:
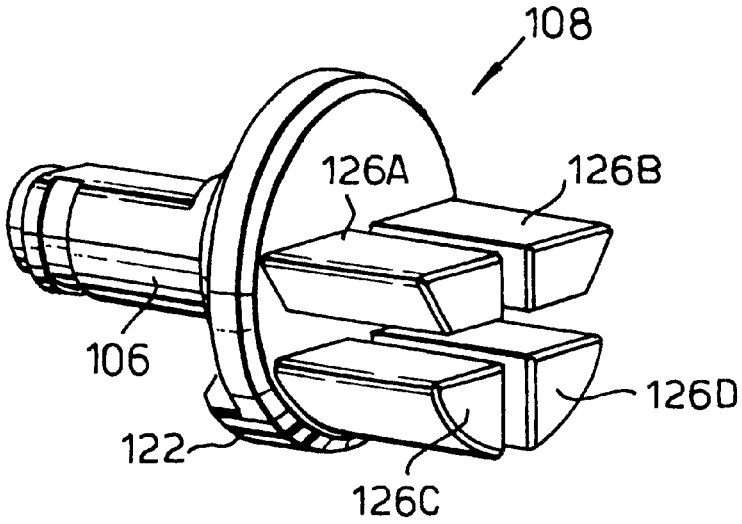
Figure 28:
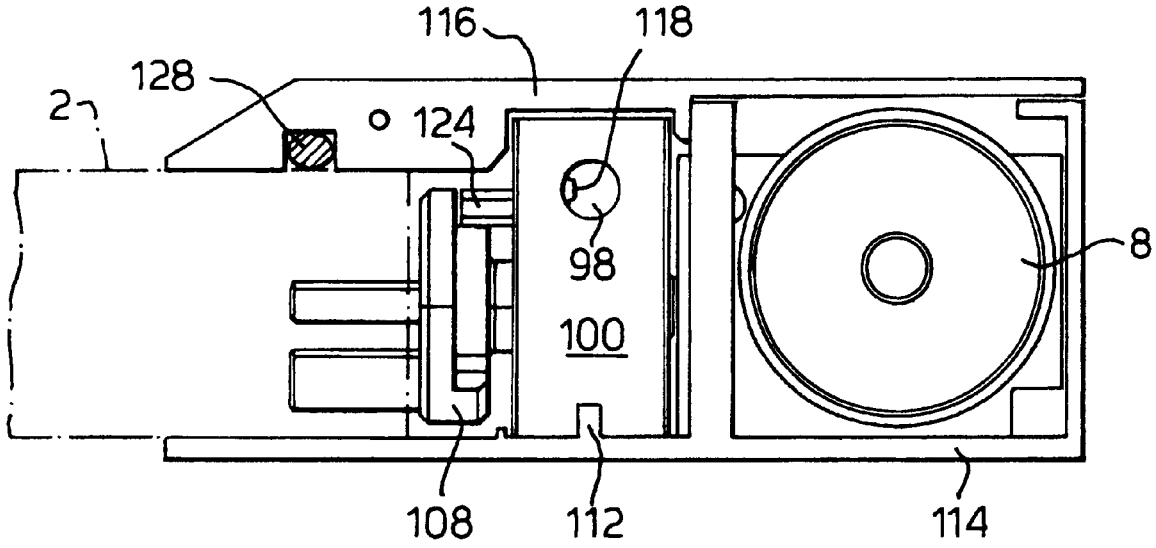

FIG. 14 is an end view of still another embodiment of the radiation-blocking member;

FIG. 15 is an exploded view of a panel according to the invention;

FIG. 16 is a perspective view, to an enlarged scale, of a portion of the assembled drive mechanism;

FIGS. 17 and 18 are perspective views illustrating a different means for rotating the radiation-blocking members;

FIGS. 19*a*–19*d* schematically show different limit positions of the radiation-blocking member;

FIG. 20 is an elevational view of the panel of a further embodiment, including a variant of the radiation-blocking member of FIG. 9;

FIG. 21 is an exploded view of the embodiment of FIG. 20;

FIG. 22 is a perspective view of part of the panel, showing the motor, the plurality of gearboxes and the drive shaft;

FIG. 23 is a view of the gearbox in cross-section along plane XXIII—XXIII in FIG. 24;

FIG. 24 is a top view of the gear box;

FIG. 25 is a view of the gearbox in cross-section along plane XXV—XXV in FIG. 24;

FIG. 26 is a perspective view of the gearbox as cross-sectioned in FIG. 23;

FIG. 27 is a perspective view of the coupling as seen from the side of the drive fingers, and FIG. 28 represents a side view showing the mechanical assembly as clamped onto the panel.

DETAILED DESCRIPTION

Figures 1, 3, 4:
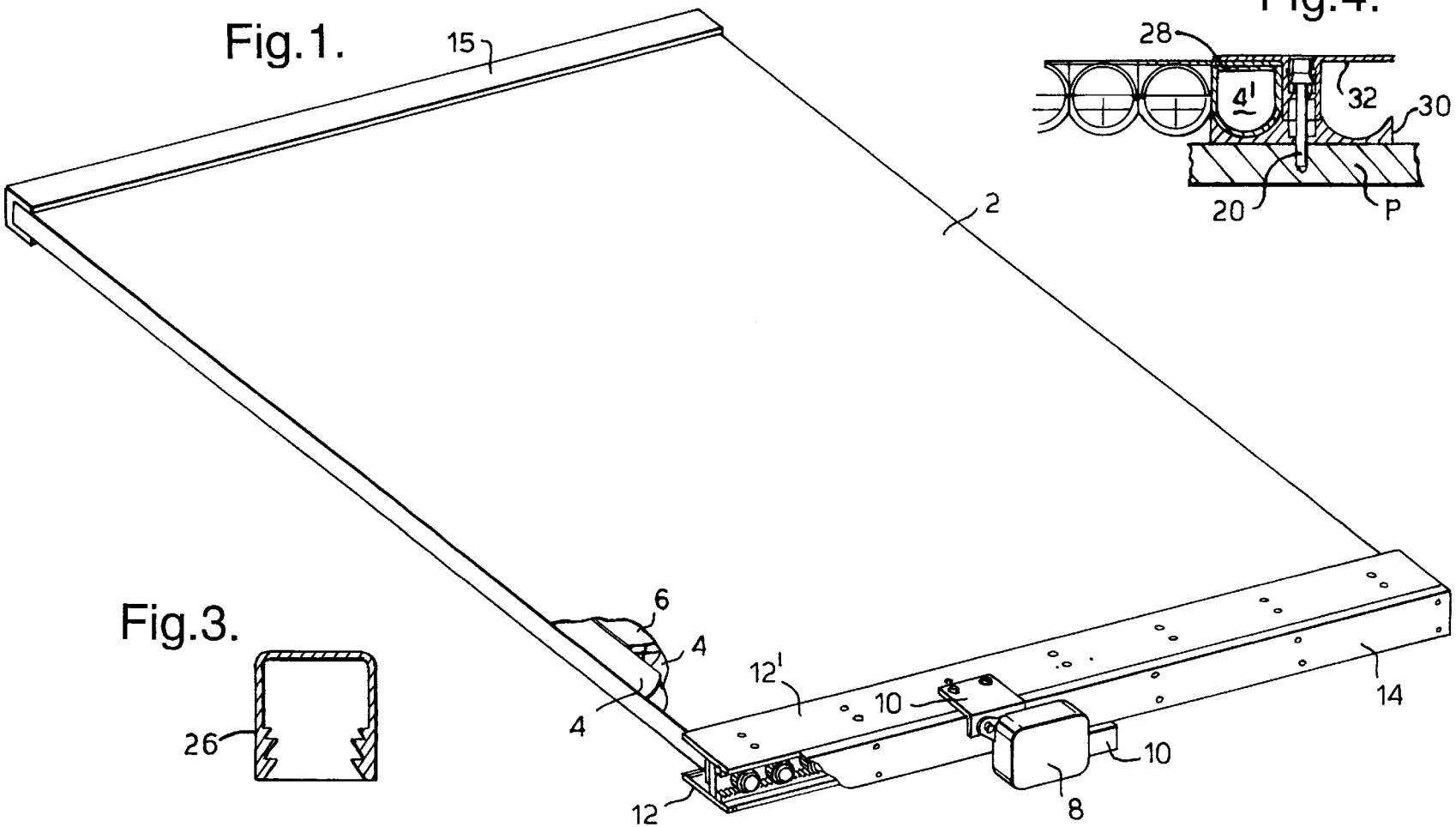

Referring now to the drawings, there is seen in FIG. 1, representing a perspective view of a complete panel according to the invention, a panel body 2 with a substantially planar top surface, and comprised of a plurality of cells 4. Advantageously, cells 4 are parts of an integral, transparent extrusion of such plastic materials as polycarbonate, PMMA or PVC, although it would be possible to produce a panel by extruding single cells and joining them side-to-side by one of the known methods (cementing, ultrasonic welding, etc.) to form a complete panel body 2. The upper, sun-facing surface of panel body 2 is advantageously given a per se known treatment to make it UV-resistant. Optional cross-sections of cells 4 will be discussed further below.

The term "light," as used in the description, is meant to include not only the spectral range of visible light, but also ranges of electromagnetic radiation below and/or above that spectral range.

Inside cells 4 there are rotatably mounted light-blocking members 6, the purpose of which is to substantially block the passage of light in one angular position, while providing a plurality of different light transmissivities in a plurality of other, angular positions. Possible configurations of light-blocking members will be described further below. Rotation of members 6 is effected by a mechanism to be explained further below.

Further seen is an electric motor 8, advantageously a 12 V, d.c. gear motor, mounted by means of two brackets 10 on a casing comprised of a lower member 12, an upper member 12' and a cover plate 14, which in FIG. 1 is partly cut away to reveal part of the mechanism to be described further below.

The rear end of panel body 2 is closed off by a plastic or metal molding 15. The first and last cells of panel body 2 do not necessarily accommodate light-blocking members 6 because, as will be shown (FIG. 4), in some embodiments the first and last cells serve for mounting the panel on the purlins of a roof structure.

As, again because of the extrusion process, the width of panel bodies 2 is limited, while no such limitations obtain regarding length, roofs are covered by cutting panel bodies to the required length and attaching them in juxtaposition to the purlins of the roof structure. To this end, the panels have to be joined side-to-side in a way that will provide mechanical strength and will also be waterproof.

Figure 2:
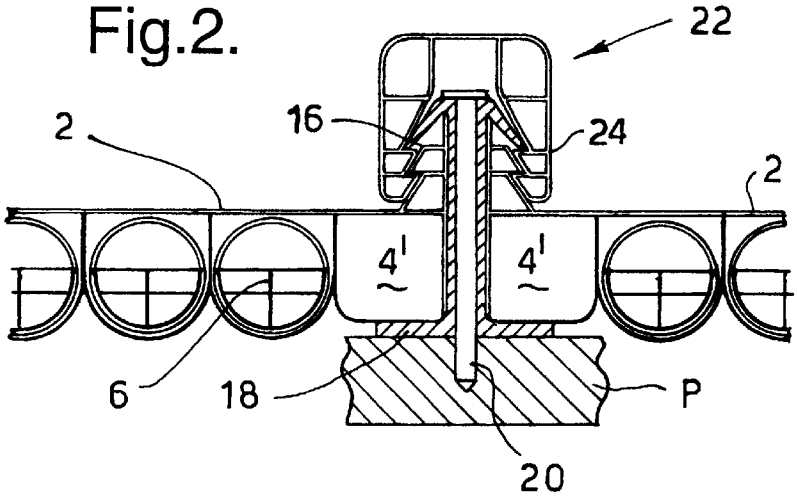

Two of many different solutions to this problem are clearly shown in FIGS. 2–4. In a first embodiment (FIG. 2), panel body 2 is provided with flanges 16 extending along both of its longitudinal edges, the inside surfaces of which flanges are saw-toothed. There is also provided an extruded, hollow, winged aluminum rail 18 between the two wings of which fit the empty cells 4' of the two adjacent panel members 2, including their respective flanges 16. After rail 18, with the adjacent panel members 2 in position as shown, has been fixedly attached to purlins P of the roof structure by means of screws 20, a plastic, U-shaped clamping rail 22 having matching saw-toothed wings 24 is pushed over flanges 16 of adjacent panel members 2, providing a strong clamping force. For even greater rigidity, instead of plastic rail 22 it is possible to use an appropriately shaped aluminum rail 26 (FIG. 3).

Another solution is illustrated in FIG. 4. Here, an aluminum extrusion 28 is introduced into empty cell 4', filling its entire longitudinal extent and imparting to it mechanical strength. Two more profiles are used: a trough-like, bottom profile 30 which fits the rounded underside of cells 4, and a two-winged, top profile 32 which rests on the upper surface of panel members 6 and, with the aid of screw 20, forces the two adjacent panel members 6 (of which only one is shown) against purlin P.

Figure 5:
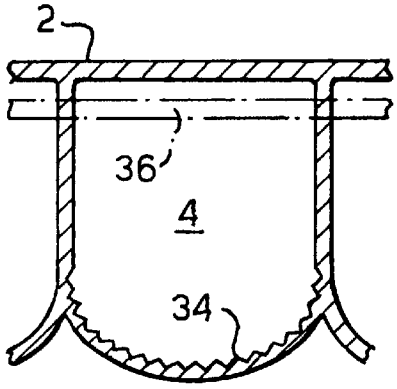

Cells 4 can have various cross-sectional shapes, such as the escutcheon shape of FIG. 5, a more elaborate form of which is provided along the rounded portion of its inner surface with prism-shaped serrations 34 which have both an aesthetic and an optical effect. The aesthetic effect is two-fold: the longitudinal lines produced are pleasing in themselves, and the serrations also hide the "innards" of the cells, in particular, scratches and wear marks that would be produced on a smooth inside surface by the rotation of light-blocking members 6. Optically speaking, the prismatic serrations produce a softer, diffused light. A second version of this profile is provided with another layer 36 below the top surface of panel body 2, for improved thermal insulation. In all cells 4 the internal height advantageously exceeds the internal width, so that flexing of the panel will not cause jamming.

Figure 6:
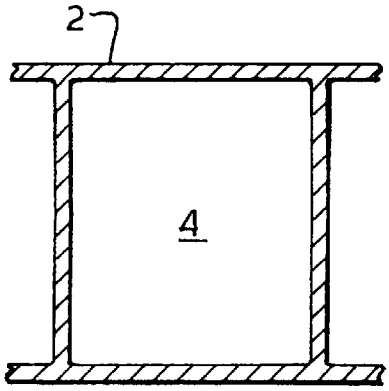

FIG. 6 shows a rectangular profile of cells 4, in which panel body 2 has two planar surfaces.

Figure 7:
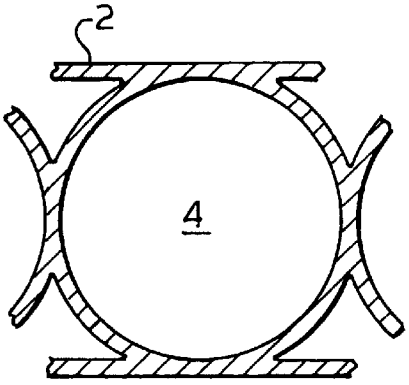

FIG. 7 shows a cell 4 with a circular profile. Panel body 2 of this embodiment also has two planar surfaces.

Figure 8:
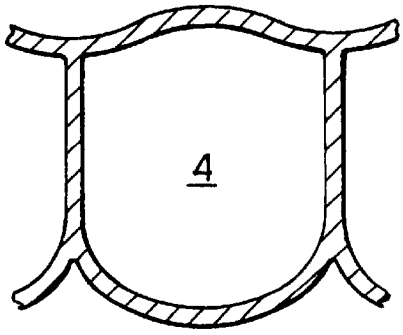

FIG. 8 is another escutcheon-type profile, with a wavy top surface.

Light-blocking members 6, as already mentioned, are rotatably mounted in cells 4 and, their surfaces having a substantially opaque portion, the angular position of this portion inside cell 4 determines the light transmissivity of the cells which, by controlling this position, may thus be controlled between a minimum and a maximum, which depends on the sky and/or the position of the sun.

A preferred embodiment of light-blocking members 6 is shown in FIG. 9. The profile, reinforced by a horizontal and a vertical rib 37, 37' respectively, is approximately semi-circular, subtending an angle of slightly more than 180°. Top surface 38 is substantially planar and is rendered opaque by such known means as painting, coating with an opaque film, or the provision of an opaque plastic layer applied by coextrusion. Top surface 38 is delimited laterally by two bead-like edges 40 which project beyond the semi-circular lower surface 42. Every 500 to 1000 mm, depending on the total length of cells 4, the edges 40 are provided with two notches or recesses 44, one opposite the other, into which are sprung plastic rings 46. It is these rings that serve as supporting elements which carry members 6 inside cells 4 and that constitute the only contact with the bottom of cell 4, as is clearly seen in FIG. 10. The advantage of this kind of mounting of members 6 is the insensitivity of members 6 to the flexure of the panel between purlins, due to snow or wind loads. Up to a surprisingly high degree, such flexures will not interfere with the rotation of members 6. The ring mounting of members 6 in fact ensures trouble-free operation of panels having a length of 12 meters and more.

Figure 11:
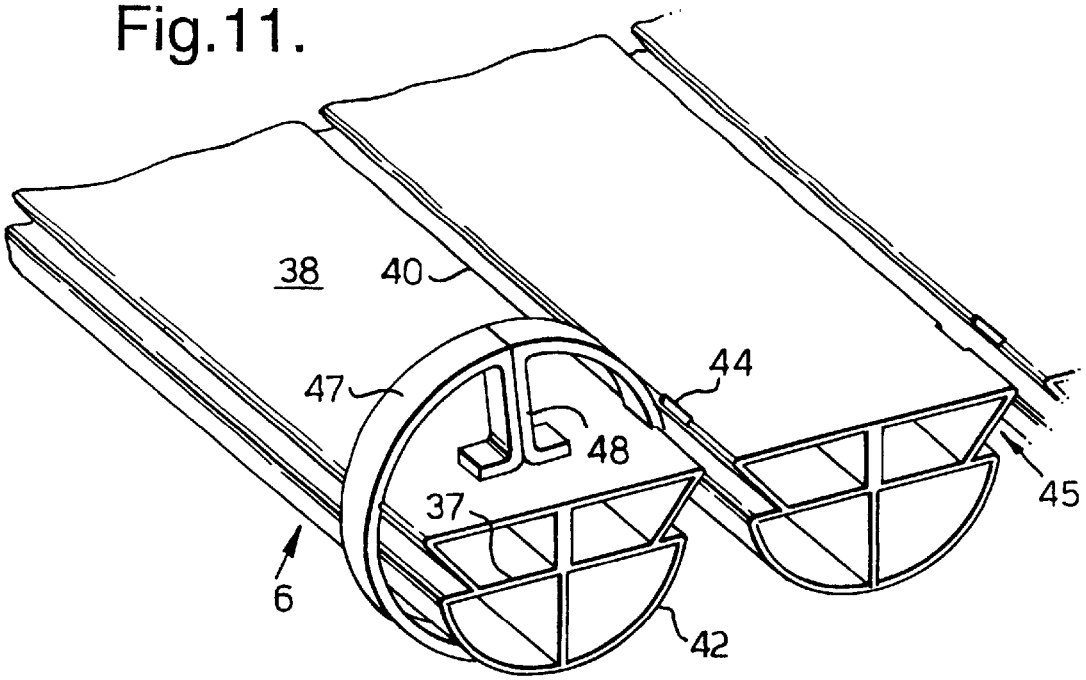

A variant of the light-blocking member of FIG. 9 is shown in FIG. 11, the difference residing in the fact that the profile portion 45 above the horizontal rib 37 is dovetail-shaped. Another difference is seen in ring 47, which is now half split, the split portion being provided with legs 48 which abut against surface 38. The advantage of ring 47, as compared to ring 46, is that while rings 46 can be applied only at the ends of member 6 and have to be slid along the latter for a considerable distance (members 6 may be as much as 12 meters long), rings 47 can be opened by elastic deformation and can be quickly snapped into their respective recesses 44 without having to be slid along member 6.

Figure 12:
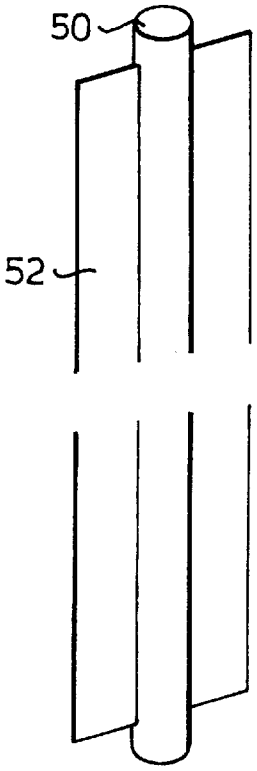

Another embodiment of the light-blocking member 6 is seen in FIG. 12, consisting of a central rod 50 and two vanes 52. Rod 50 is supported at both ends and vanes 52 rotate inside cell 4. While for short light-blocking members as required, e.g., in windows or skylights, this embodiment needs supports only at its end, longer members of this type must also be supported at one or more points along their longitudinal extent.

Figure 13:
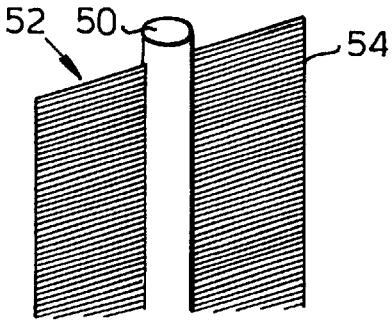

A variant of the light-blocking member of FIG. 12 is seen in FIG. 13, in which vanes 52 are not solid, but consisting of narrow strips 54 or even bristles. An arrangement like this would reduce the disturbing effect of panel flexure.

Yet another embodiment of light-blocking member 6 is represented in FIG. 14. The member 6 is in the form of a plastic tube 56 of circular cross-section. About half the circumference of tube 56 is rendered opaque by painting, coating with an opaque film, or the provision of an opaque plastic layer applied by coextrusion.

In the following, a detailed description will be given of the mechanism driving light-blocking members 6.

FIG. 15 is an exploded view of the drive mechanism. Power flow is quite simple: motor 8 drives one of a plurality of gears 58 via a coupling 60A, 60B. Each one of gears 58 is mounted on the first member 62A of a 3-member Oldham coupling (a coupling extremely tolerant of lack of alignment between input and output shafts). All gears 58 mesh with a lower rack 64 and an upper rack 64', each of which is slidably seated in grooves 66, 66' respectively, provided in lower and upper casing members 12, 12' respectively. (Although one rack 64 would do, a pure torque, i.e., a force for rotation without lateral components, requires two racks.)

When the gear directly driven by motor 8 rotates, it causes racks 64, 64' to slide in opposite directions in their respective grooves 66, 66', thereby rotating the rest of gears 58. Via second coupling member 62B, first member 62A rotates third member 62C, the output end of which is shaped to fit the cavities of light-blocking member 6 and thus rotate the latter.

Referring now also to FIG. 16, there is further seen a bearing wall 68 fixedly mounted between lower and upper casing members 12, 12' and provided with holes 70 which serve as bearings for the shafts of first coupling members 62A. Third coupling members 62C are supported in cells 4 by the first of rings 46.

Also seen is a split wall 72, 72' (FIG. 15), which, as is clearly seen in FIG. 16, serves to maintain the integrity of each coupling as comprised of members 62A, 62B, 62C by preventing member 62C from disengaging from member 62B. The semi-circular recesses 74 do not serve as bearings for collar 76 of third coupling member 62; in fact, for the coupling to accommodate unavoidable deviations of alignment, the diameter of recesses 74 must be much larger than the diameter of collar 76.

Further seen in FIG. 15 and, to better advantage, in FIG. 16, are rings 78 which have a slightly tapered bore and, when pushed onto the slotted, slightly tapered hub 80 of gears 58, clamp the latter onto shaft 82 of gears 58.

Also seen in FIG. 16 are grooves 84 for rubber cords to act as seals when the assembled mechanism is mounted on panel body 2 (see FIG. 1). Similar grooves are obviously also provided in the upper casing member 12'.

FIG. 15 also shows two limit switches 86, 86' which define the extremes of the rack movement and, thus, of the rotation of light-blocking members 6. The limits of this rotation will be discussed further below. It will be appreciated that limit switches 86, 86' could also be integral components of gear motor 8.

FIGS. 17 and 18 illustrate another means for rotating the light-blocking members 6, which means, although conceived for use with the light-blocking member shown in FIG. 12 or 13, could also be modified for use with the above-described rack and gear mechanism. Using the same spring collet means that served to fixedly mount gears 58 (FIG. 16) on coupling member shaft 82, levers 88 (FIG. 17) are attached to shafts 50 of vanes 52 in FIG. 12, each lever 88 being provided with a pin 90. A bar 92 (FIG. 18) with appropriately spaced and sized holes is slipped over all pins 90 and when one of levers 88 is coupled to motor 8, is rotary motion is transmitted to all levers 88 and thus to all vanes 52.

In the following are discussed the range and control of the rotational movement of light-blocking members 6.

Starting, as schematically shown in FIGS. 19*a*–19*d*, from the position of full opacity in which the opaque surface 38 of light-blocking member 6 is substantially parallel to the surface of panel body 2, member 6 is limited to an angular range of rotation of 90° in both the clockwise and counter-clockwise senses. These limits are enforced by limit switches 86, 86' tripped by rack 64 (FIG. 15). Setting out from the blocking position (FIG. 19*a*) and rotating in the clockwise sense, surface 38 sweeps a first quadrant of the celestial hemisphere and is stopped by limit switch 86 in the position shown in FIG. 19*b*, in which it is perpendicular to the panel surface, i.e., for maximum transmissivity when the sun is at its highest point. In order to sweep the second quadrant, the sense of rotation must be reversed, with member 6 returning and passing through the opaque position (FIG. 19*c*), after which the second quadrant is swept, with member 6 being stopped by limit switch 86'.

Another embodiment of the panel according to the invention is illustrated in FIGS. 20–28. Panel body 2 is substantially identical with that of the previous embodiment, with cells 4 being of the rectangular type shown in FIG. 6. Light-blocking members 6 are of the type shown in FIG. 9, but may also be of an alternative design, also shown in FIG. 20: fully tubular, with an integral diametric partition 39 produced from an opaque plastic material by co-extrusiion with the transparent tubular part. Mounting of panel body 2 on the roof purlins is analogous to the procedure explained in conjunction with the previous embodiment.

FIG. 21 illustrates the power flow whereby the rotary movement of an electric motor is transmitted to the light-blocking members. There is seen an electric gear motor 8 which, via two gears 94, 96 drives a slotted drive shaft 98 that extends along the entire panel width, as seen in FIG. 22. Located inside a gearbox 100, of which there is one for each cell 4, and keyed to shaft 98, there is provided a worm 102 engaging a worm gear 104, equally located in gearbox 100 and keyed to shaft 106 of coupling 108. The latter constitutes the link between the mechanism described in the aforegoing and the light-blocking member 6.

It will be noticed that coupling 108 is much simpler than the three-member Oldham coupling 62A, 62B, 62C of FIGS. 15, 16 of the previous embodiment. The Oldham coupling, which, as was explained earlier, is extremely tolerant of misalignment between input and output shafts, was needed to take care of the variations, unavoidable in plastic extrusions, of the distances between cells 4. In the present embodiment, this problem is solved by mounting the one-piece couplings 108 in gearboxes 100 that are rendered "floating" by means of slots 110 which provide them with one degree of freedom in translation along a rail 112, thus permitting each gearbox 100 and thereby, each coupling 108, to find its proper position relative to the respective cell 4. Rail 112 is part of an aluminum profile 114 that accommodates the entire mechanism, including motor 8 attached to profile 114 by means of a bracket 115. Panel 2 is tightly clamped between profile 114 and another profile that also serves as cover plate 116.

FIGS. 23–26 represent gearbox 100 and its associated components. Seen is worm 102 slidable along, but driven in rotation by, shaft 98 by means of a key 118 (FIG. 23). Worm 102 engages worm gear 104, which is keyed to shaft 106 of coupling 108. Shaft 106, as can be seen in FIGS. 23 and 26, is mounted in appropriately located and sized bores 120 in gearbox 100 (FIG. 21). Strictly speaking, worm gear 104 should be of the helical type, with the helix angle o its teeth corresponding to the lead angle of worm 102. While for maximum efficiency and service life, this is indeed the appropriate solution, considering the fact that required speeds are very low and forces are relatively smal, simple spur gears should also do. Since all transmissiion components (except shaft 98) are advantageously designed as plastic moldings, extraction, from the mold, of a helical gear would greatly complicate the mold by demanding an additional mechanism to produce the required helical extraction movement.

Shaft 106 ends in a flange 122 which is relieved to a depth of about half its thickness for over about three-quarters of its circumference. Into this relieved portion projects a ring segment 124 which is an integral part of gearbox 100 and serves as a stop as well as a reference point for purposes of assembly of the panel unit. Further seen in FIGS. 23, 24, 26 and especially in the perspective view of FIG. 27, are drive fingers 126A, B, C, D which are integral parts of coupling 108 and are configured to enter the spaces defined by ribs 37, 37 in FIG. 21 and drive light-blocking members 6 (FIG. 21). For use with the cylindrical variant of light-blocking member 6 shown in FIG. 20, the shape of drive fingers 126 must obviously be modified.

FIG. 28 is a side view showing the lower end of panel 2, onto which are clamped profiles 114 and 116 which, between them, accommodate the entire mechanism, including motor 8. Waterproofing is ensured by means of a seal 128 located in a groove in cover plate 116 and extending along the entire width of panel 2.

This embodiment, too, may have limit switches defining limit positions, with the switch body attached to a stationary part of the mechanism, and the switch being tripped by a moving part thereof.

Obviously, light-blocking members 6 can be stopped at any angular position, also between the limit positions defined by the limit switches, by controlling member 8. This can be done either manually or automatically. Manual control is effected by operating a spring-loaded, polarity-reversing pushbutton. Also required is a power supply including a voltage stabilizer and a thermal fuse to protect motors 8. To obtain satisfactory automatic control, it is best to use a stepping motor controlled by a microprocessor working with a program including all parameters involved in the proper operation of the panels, such as limits of rotation in the clockwise and counter-clockwise senses (thereby eliminating the need for limit switches), opening of light-blocking members 6 as a function of the prevailing light as sensed by photodetectors, dimming of artificial illumination in dependence of natural light entering through the panels, stopping motors in case of overload, etc.

Clearly, the user can always override the program or introduce whatever changes are desired. The program can also be designed to switch off the system on weekends or during vacations.

The panel according to the invention will operate in all positions: horizontal, vertical, slanted, even slightly arched.

While the above-described drives are indeed preferred, other types of drives are also possible, e.g., chain or timing-belt drives.

Although in the foregoing the term "manual" was meant to refer to the manual activation of gear motor 8, it will be appreciated that embodiments are envisaged in which the panel according to the invention, instead of, or in addition to, being driven by the gear motor, can also be operated manually.

I claim:

1. A panel of controllable radiation transmissivity, comprising:

a plurality of rotatably mounted radiation-blocking members, each of said members having at least one portion which is substantially opaque, and means for rotating said radiation-blocking members, said radiation-blocking members, when rotated, being adapted in at least one angular position to substantially block the passage of radiation through said panel, and in a plurality of other, selectable, angular positions, to provide a plurality of differing radiation transmissivities, characterized by a plurality of substantially transparent tubular cells, said radiation-blocking members being mounted in at least some of said tubular cells, and means for rotating said radiation-blocking members inside said tubular cells.

2. The panel as claimed in claim 1, wherein said plurality of tubular cells is part of an integral plastic extrusion.

3. The panel as claimed in claim 1, wherein said tubular cells have an escutcheon-shaped cross-section.

4. The panel as claimed in claim 1, wherein said tubular cells have a rectangular cross-section.

5. The panel as claimed in claim 1, wherein said tubular cells have a circular cross-section.

6. The panel as claimed in claim 1, wherein said tubular cells are provided with at least one additional layer below the top surface of said panel for improved thermal insulation.

7. The panel as claimed in claim 1, wherein said radiation-blocking members are in the form of tubular members, each defined by a substantially half-cylindrical portion and a substantially planar portion.

8. The panel as claimed in claim 7, wherein said substantially planar portion is substantially opaque, while said half-cylinder is substantially transparent.

9. The panel as claimed in claim 7, wherein said tubular members are provided with at least one reinforcing rib.

10. The panel as claimed in claim 7, wherein the longitudinal edges of said planar portion are provided with spaced-apart pairs of recesses, the recesses of each pair being located one opposite the other.

11. The panel as claimed in claim 7, wherein said radiation-blocking members are provided with supporting elements.

12. The panel as claimed in claim 11, wherein said supporting elements are in the form of a plurality of rings of an outside diameter larger than the width of said tubular members, but smaller than the width of said tubular cells, which rings are distributed substantially uniformly along said members, each ring being retained at its location by being sprung into a pair of said recesses, whereby said rings carry said members inside said tubular cells and constitute the only contact with said tubular cells.

13. The panel as claimed in claim 12, wherein said rings are split, facilitating their mounting on said radiation-blocking members.

14. The panel as claimed in claim 1, wherein said radiation-blocking members are in the form of two substantially co-planar vanes attached to either side of a central rod.

15. The panel as claimed in claim 1, wherein said radiation-blocking members are in the form of substantially cylindrical tubes, each having a substantially planar, substantially diametrically located partition wall.

16. The panel as claimed in claim 15, wherein said partition wall is substantially opaque, while said cylindrical tubes are substantially transparent.

17. The panel as claimed in claim 1, wherein said means for rotating said radiation-blocking members is at least one electric gear motor.

18. The panel as claimed in claim 17, wherein said motor is coupled to a gear wheel which, when rotated by said motor, is adapted to drive one of said radiation-blocking members.

19. The panel as claimed in claim 18, wherein each of said radiation-blocking members of said panel is in a drive connection with a gear wheel, all gears wheels of all of said members being in mesh with at least one rack guidedly slidable in a casing of said panel, wherein said gear wheel coupled to said motor, when rotated, causes said rack to slide, thereby setting all other gear wheels rotating.

20. The panel as claimed in claim 18, further comprising at least one limit switch actuatable by said at least one rack in order to define one limit position thereof.

21. The panel as claimed in claim 1, wherein said means for rotating said radiation-blocking members is an electric stepping motor.

22. The panel as claimed in claim 21, further comprising a drive shaft driven by said electric stepping motor.

23. The panel as claimed in claim 21, wherein said drive shaft extends along the entire width of said panel.

24. The panel as claimed in claim 23, wherein said drive shaft is provided with a key slot extending along its entire length.

25. The panel as claimed in claim 24, wherein said slotted drive shaft passes through, and is in a drive connection with, a plurality of worms of worm gears and allows said worms one degree of freedom in translation.

26. The panel as claimed in claim 25, wherein said worm gears are mounted on the input shaft of a coupling, the output side of which is configured to enter and drive at least one radiation-blocking member.

27. The panel as claimed in claim 1 wherein said means for rotating said radiation blocking members are in gearboxes floatingly mounted on a rail of a profile.

28. A panel of controllable radiation transmissivity, comprising:

a plurality of substantially transparent tubular cells;

a plurality of radiation-blocking members with each having at least one portion which is substantially opaque, and said radiation-blocking members being positioned within said transparent tubular cells; and a drive mechanism which is in driving communication with said radiation-blocking members, and said radiation-blocking members being rotatably mounted within said tubular cells such that said radiation-blocking members rotate internally within said tubular cells upon activation of said drive mechanism, and when rotated, said radiation-blocking members are adapted, in at least one angular position, to substantially block the passage of radiation through said panel, and, in a plurality of other, selectable, angular positions, to provide a plurality of differing radiation transmissivities.

29. The panel of claim 28, wherein said plurality of tubular cells form part of an integral plastic extrusion.

30. A panel of controllable radiation transmissivity, comprising:

a plurality of substantially transparent tubular cells in side-by-side abutment;

a plurality of radiation-blocking members with each having at least one portion which is substantially opaque, said radiation-blocking members being rotatably received within said transparent tubular cells for rotation of said radiation-blocking members inside said transparent tubular members;

means for rotating said radiation-blocking members inside said tubular cells, and said radiation-blocking members, when rotated, being adapted in at least one angular position to substantially block the passage of radiation through said panel, and in a plurality of other, selectable, angular positions, to provide a plurality of differing radiation transmissivities.

31. The panel of claim 30, wherein said plurality of tubular cells is part of an integral plastic extrusion.

* * * * *